US008770237B2

(12) United States Patent
Bolt et al.

(10) Patent No.: US 8,770,237 B2
(45) Date of Patent: Jul. 8, 2014

(54) VAPOR RECOVERY PUMP REGULATION OF PRESSURE TO MAINTAIN AIR TO LIQUID RATIO

(75) Inventors: David Bolt, Ducansville, PA (US); Dale Spence, St. Louis, MO (US); Dale Ewing, Hollidaysburg, PA (US); David Jonathan Hassell, Titirangi (NZ); John Layne, Perth (AU); Lindsay Bruce Dalziel, Auckland (NZ)

(73) Assignee: Veeder-Root Company, Simsbury, CT (US)

( * ) Notice: Subject to any disclaimer, the term of this patent is extended or adjusted under 35 U.S.C. 154(b) by 678 days.

(21) Appl. No.: 12/906,879

(22) Filed: Oct. 18, 2010

(65) Prior Publication Data

US 2011/0162753 A1 Jul. 7, 2011

Related U.S. Application Data

(60) Provisional application No. 61/252,822, filed on Oct. 19, 2009, provisional application No. 61/314,831, filed on Mar. 17, 2010.

(30) Foreign Application Priority Data

Apr. 1, 2010 (NZ) ..... 584410

(51) Int. Cl.
*B65B 31/00* (2006.01)
*B67D 7/54* (2010.01)

(52) U.S. Cl.
CPC ..... *B67D 7/54* (2013.01)
USPC ..... 141/59; 141/7; 141/198; 141/285

(58) Field of Classification Search
USPC ..... 141/7, 59, 198, 285
See application file for complete search history.

(56) References Cited

U.S. PATENT DOCUMENTS

| | | | | |
|---|---|---|---|---|
| 5,038,838 | A | 8/1991 | Bergamini et al. | |
| 5,040,577 | A | 8/1991 | Pope | |
| 5,327,944 | A | 7/1994 | Healy | |
| 5,484,000 | A * | 1/1996 | Hasselmann | 141/7 |
| 5,494,409 | A | 2/1996 | Webb et al. | |
| 5,542,458 | A * | 8/1996 | Payne et al. | 141/7 |

(Continued)

OTHER PUBLICATIONS

PCT International Search Report dated Dec. 10, 2010, regarding co-pending PCT Application No. PCT/US2010/053131 filed Oct. 19, 2010.

(Continued)

*Primary Examiner* — Timothy L Maust
(74) *Attorney, Agent, or Firm* — Nelson Mullins Riley & Scarborough, LLP

(57) ABSTRACT

A method of operating a vapor recovery system that recovers vapors expelled from a vehicle during refueling at a fuel dispensing point and returns the vapors to an underground storage tank through a vapor flow path that is in fluid communication with an air to liquid regulator valve and a vapor pump. The method includes dispensing fuel into the vehicle through the fuel dispensing point, regulating an amount of vapor that is recovered through the fuel dispensing point with the air to liquid regulator valve in proportion to the fuel dispensed into the vehicle, detecting a parameter of the vapor recovery system, and maintaining a substantially constant pressure level in a first portion of the vapor return path that is disposed between the vapor pump and the air to liquid regulator valve.

24 Claims, 7 Drawing Sheets

(56) References Cited

U.S. PATENT DOCUMENTS

| | | | | | |
|---|---|---|---|---|---|
| 5,782,275 | A | | 7/1998 | Hartsell, Jr. et al. | |
| 5,816,297 | A | * | 10/1998 | Olson et al. | 141/59 |
| 5,850,857 | A | * | 12/1998 | Simpson | 141/59 |
| 5,860,457 | A | | 1/1999 | Andersson | |
| 5,865,602 | A | * | 2/1999 | Nozari | 417/44.1 |
| 5,868,175 | A | * | 2/1999 | Duff et al. | 141/59 |
| 5,878,790 | A | * | 3/1999 | Janssen | 141/59 |
| 5,904,472 | A | * | 5/1999 | Olson et al. | 417/405 |
| 6,095,204 | A | * | 8/2000 | Healy | 141/59 |
| 6,131,621 | A | | 10/2000 | Garrard | |
| 6,223,789 | B1 | * | 5/2001 | Koch | 141/59 |
| 6,332,483 | B1 | | 12/2001 | Healy | |
| 6,532,999 | B2 | * | 3/2003 | Pope et al. | 141/59 |
| 6,830,080 | B2 | * | 12/2004 | Nanaji | 141/59 |
| 6,899,149 | B1 | * | 5/2005 | Hartsell et al. | 141/192 |
| 6,901,786 | B2 | | 6/2005 | Hart | |
| 7,275,417 | B2 | | 10/2007 | Hart | |
| 7,566,358 | B2 | * | 7/2009 | Hart et al. | 96/110 |
| 2007/0267088 | A1 | | 11/2007 | Hughes | |

OTHER PUBLICATIONS

U.S. Appl. No. 12/858,802, filed Aug. 18, 2010.

* cited by examiner

VAPOR RECOVERY PUMP REGULATION OF PRESSURE TO MAINTAIN AIR TO LIQUID RATIO

CLAIM OF PRIORITY

This application claims priority to New Zealand Provisional Patent Application No. 584410, filed Apr. 1, 2010, U.S. Provisional Patent Application Ser. No. 61/314,831, filed Mar. 17, 2010, and U.S. Provisional Patent Application Ser. No. 61/252,822, filed Oct. 19, 2009, the entire disclosures of which are incorporated by reference herein.

FIELD OF THE INVENTION

The present invention generally relates to the recovery of fuel vapors in connection with a liquid fuel dispensing facility. More particularly, the present invention relates to controlling the volume of fuel vapor recovered to ensure that the volume is in appropriate proportion to the volume of liquid fuel being dispensed.

BACKGROUND OF THE INVENTION

Liquid fuel dispensing facilities (i.e. gasoline stations) often suffer from a loss of fuel to the atmosphere due to inadequate vapor collection during fuel dispensing activities, excess liquid fuel evaporation in the containment tank system, and inadequate reclamation of the vapors during tanker truck deliveries. Lost vapor is an air pollution problem which is monitored and regulated by both the federal and state governments. Attempts to minimize losses to the atmosphere have been effected by various vapor recovery methods. Such methods include: "Stage-I vapor recovery" where vapors are returned from the underground fuel storage tank to the delivery truck; "Stage-II vapor recovery" where vapors are returned from a refueled vehicle tank to the underground storage tank; vapor processing where the fuel/air vapor mix from the underground storage tank is received and the vapor is liquefied and returned as liquid fuel to the underground storage tank; burning excess vapor off and venting the less polluting combustion products to the atmosphere; and other fuel/air mix separation methods.

When working properly, Stage-II vapor recovery results in equal exchanges of air or vapor (A) and liquid (L) between the main fuel storage tank and the consumer's gas tank. Ideally, Stage-II vapor recovery produces an A/L ratio very close to 1.0. In other words, returned vapor replaces an equal amount of liquid in the main fuel storage tank during refueling transactions. When the A/L ratio is close to 1.0, refueling vapors are collected, the ingress of fresh air into the storage tank is minimized, and the accumulation of an excess positive or negative pressure in the main fuel storage tank is prevented. This minimizes losses at the fuel dispensing nozzle and evaporation and leakage of excess vapors from the storage tank. Measurement of the A/L ratio thus provides an indication of proper Stage-II vapor collection operation. A low A/L ratio means that the proper amount of fuel vapor is not being recovered for the amount of fuel that has been dispensed.

The present invention recognizes and addresses considerations of prior art constructions and methods.

SUMMARY OF THE INVENTION

One embodiment of the present invention provides a system for controlling a vapor recovery system that recovers vapors expelled from a vehicle during refueling at a fuel dispensing point and returns the vapors to an underground storage tank in a service station environment. The system includes an air to liquid regulator valve associated with the fuel dispensing point, the air to liquid regulator valve being configured to regulate an amount of vapor that is recovered through the fuel dispensing point for a given amount of fuel that is dispensed through the fuel dispensing point. A vapor pump is in fluid communication with the air to liquid regulator valve, the vapor pump having an inlet side and an outlet side. A vapor flow path is in fluid communication with the air to liquid regulator valve and the vapor pump, and a controller is operatively connected to the vapor recovery system. The controller monitors a parameter of the vapor recovery system, and maintains a substantially constant pressure level in a first portion of the vapor flow path that is disposed between the inlet side of the vapor pump and the air to liquid regulator valve.

The present invention also provides a method of operating a vapor recovery system that recovers vapors expelled from a vehicle during refueling at a fuel dispensing point and returns the vapors to an underground storage tank through a vapor flow path that is in fluid communication with an air to liquid regulator valve and a vapor pump. The method includes dispensing fuel into the vehicle through the fuel dispensing point, regulating an amount of vapor that is recovered through the fuel dispensing point with the air to liquid regulator valve in proportion to the fuel dispensed into the vehicle, detecting a parameter of the vapor recovery system, and maintaining a substantially constant pressure level in a first portion of the vapor return path that is disposed between the vapor pump and the air to liquid regulator valve.

Other objects, features and aspects for the present invention are discussed in greater detail below. The accompanying drawings are incorporated in and constitute a part of this specification, and illustrate one or more embodiments of the invention. These drawings, together with the description, serve to explain the principles of the invention.

BRIEF DESCRIPTION OF THE DRAWINGS

A full and enabling disclosure of the present invention, including the best mode thereof, to one of ordinary skill in the art, is set forth more particularly in the remainder of this specification, including reference to the accompanying drawings, in which.

Figure 1:
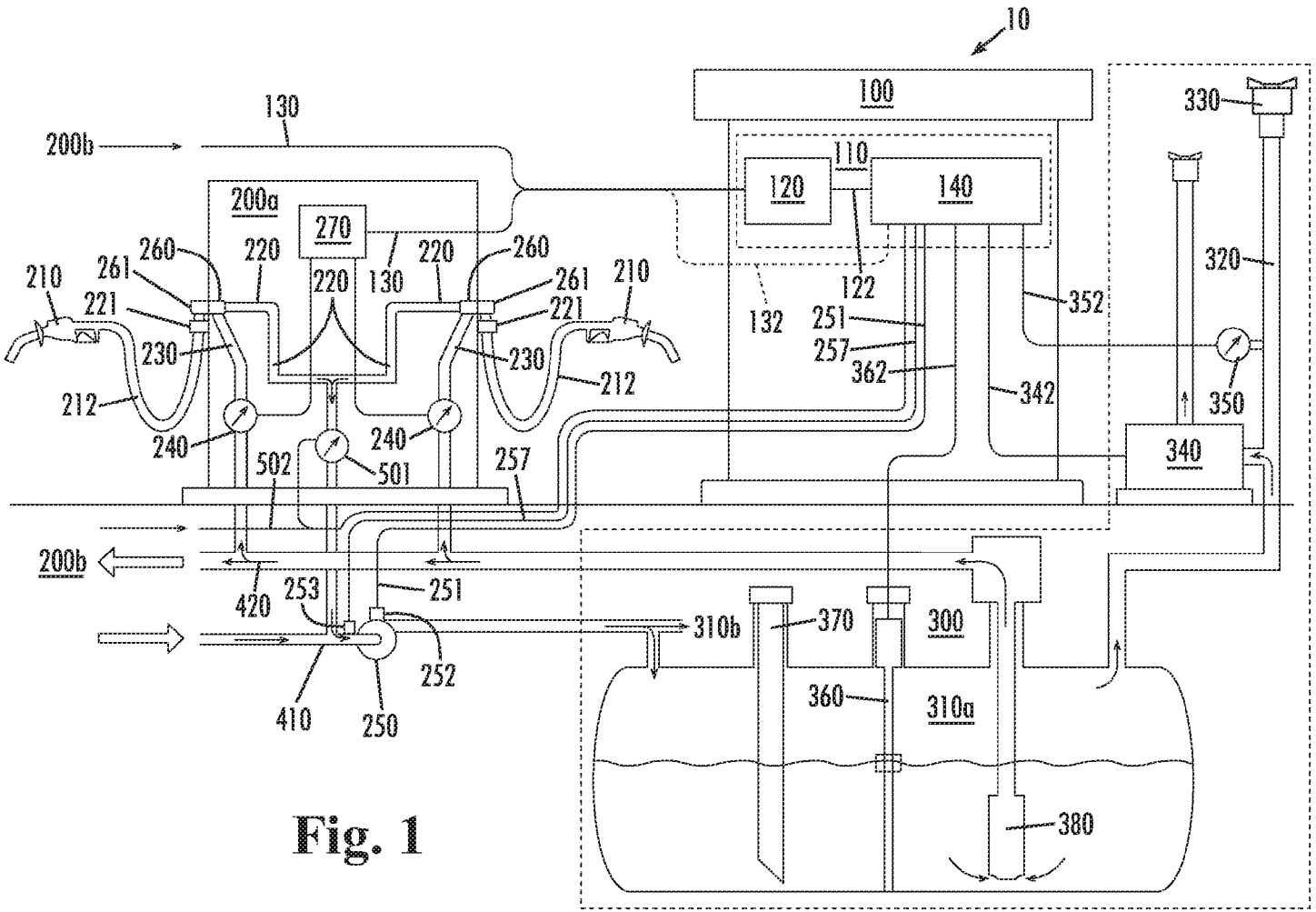
FIG. 1 is a diagrammatic representation of a liquid fuel dispensing facility including a fuel vapor recovery system in accordance with a first embodiment of the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

A first embodiment of the present invention is described in connection with FIG. 1, which shows a vapor recovery system for use in a liquid fuel dispensing facility 10, in accordance with the present invention. As shown, the fuel dispensing facility 10 includes a station house 100, one or more fuel dispenser units 200*a* and 200*b* (fuel dispenser unit 200*b* is not shown), a main fuel storage system 300, means for connecting the fuel dispenser units 200*a* and 200*b* to the main fuel storage system 300, and one or more vapor (or air) flow sensors (AFS's) 501. The fuel dispenser units 200*a* and 200*b* may be the ENCORE® sold by Gilbarco, inc. of Greensboro, N.C., or other fuel dispenser, such as that disclosed in U.S. Pat. No. 4,978,029, which is hereby incorporated by reference in its entirety.

As illustrated in FIG. 1, the station house 100 includes a central electronic control system 110 that includes a dispenser controller 120 (also known as a site controller or point-of-sale system), dispenser current loop interface wiring 130 connecting the dispenser controller 120 with the fuel dispenser unit(s) 200*a* and 200*b*, and a data acquisition system 140. The dispenser controller 120 controls the fuel dispenser units 200*a* and 200*b* and processes transaction information received from the dispensers 200 over the current loop 130. The dispenser controller 120 is in electrical communication with the data acquisition system 140, such as by a first wiring bus 122. The interface wiring 130 may be electrically connected to the data acquisition system 140 by a second wiring bus 132. The dispenser controller 120 may be the Gilbarco G-Site® or Passport® point-of-sale system.

The data acquisition system 140 preferably includes standard computer storage and central processing capabilities, keyboard input device(s), and audio and visual output interfaces among other conventional features. Entities such as the California Air Resources Board (CARB) have produced requirements for Enhanced Vapor Recovery (EVR) equipment. These include stringent vapor recovery system monitoring requirements to determine continuously whether or not the systems are working properly. In locations subject to these enhanced requirements, the data acquisition system 140 may also function as an in-station diagnostic monitor. For example, where required, the data acquisition system 140 may be the Veeder-Root Company TLS-350™ tank monitor. Both the dispenser controller 120 and the data acquisition system 140 may be further communicatively coupled to an off-site or remote system (not shown) for communicating information and receiving instructions remotely, in which case both systems may communicate with the remote system over telephone lines or other network lines, including the Internet.

Figure 2:
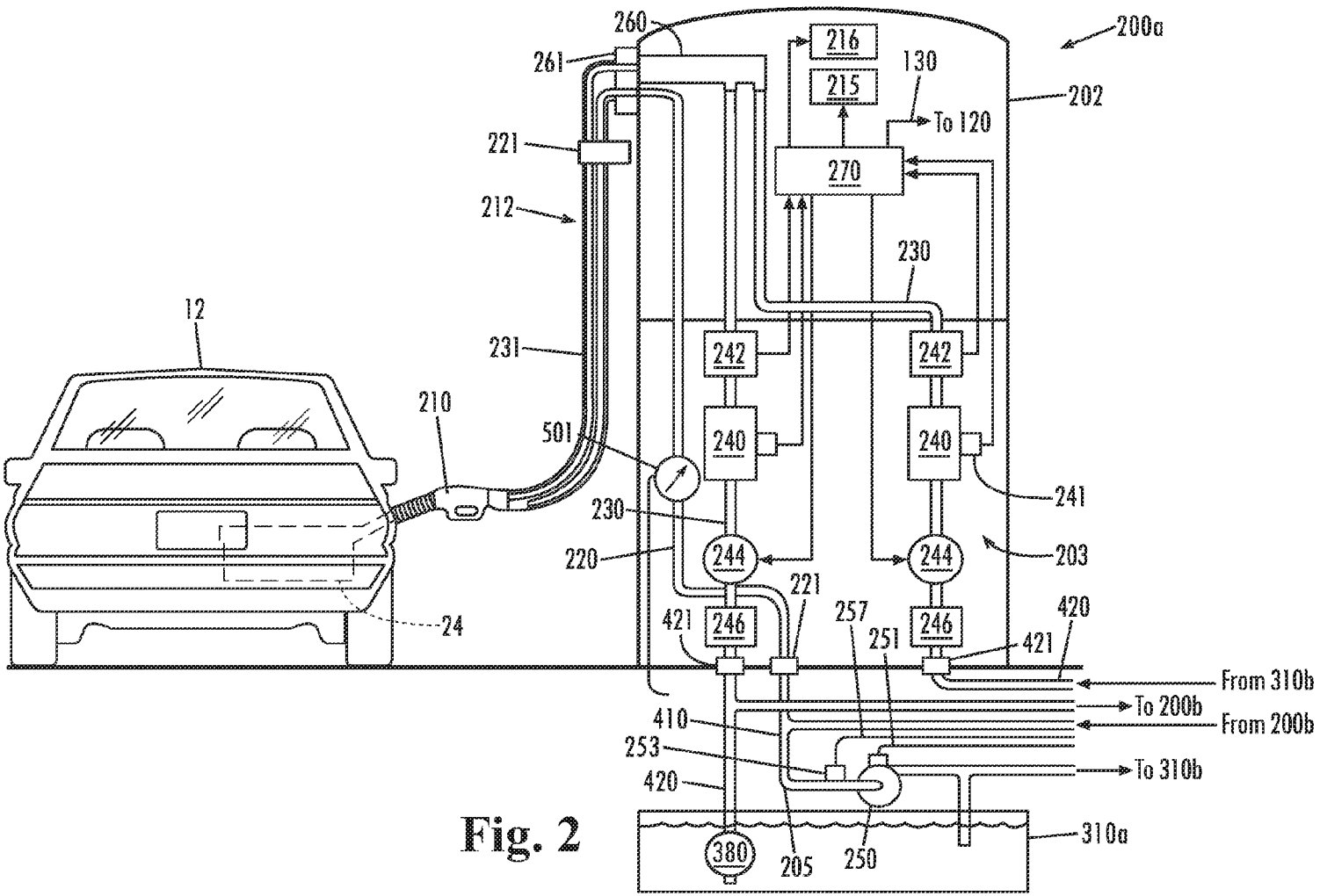
FIG. 2 is a diagrammatic representation of the fuel dispenser as shown in FIG. 1.
Figure 3:
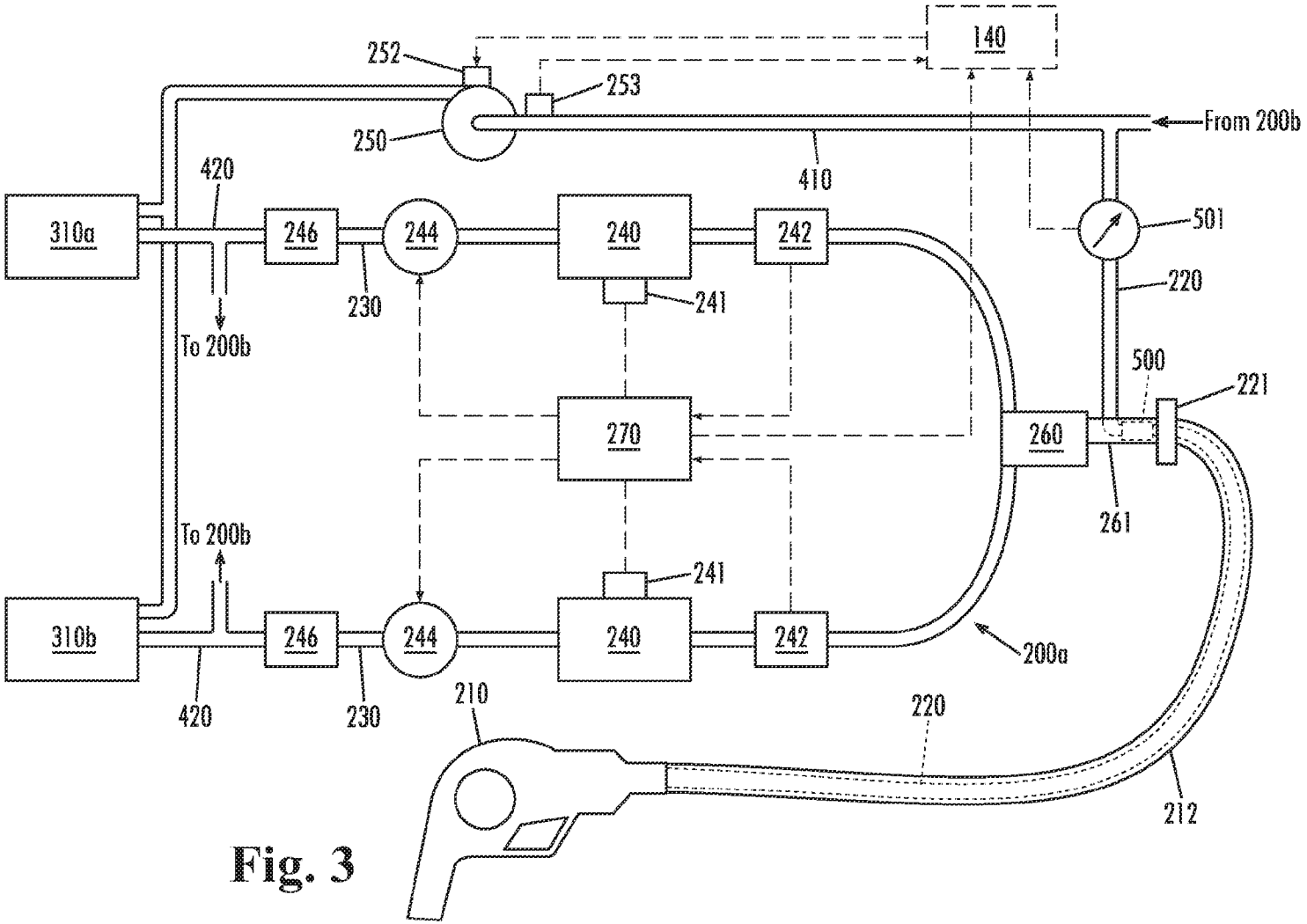
FIG. 3 is a schematic diagram illustrating certain operational characteristics of the fuel dispenser unit as shown in FIG. 2.

Referring additionally to FIGS. 2 and 3, the fuel dispenser units 200*a* and 200*b* may be provided in the form of conventional "gas pumps." Each of the fuel dispenser units 200*a* and 200*b* may include one or more fuel dispensing points typically defined by nozzles 210. In the preferred embodiment shown, the fuel nozzles 210 are suitable vapor recovery nozzles used in combination with a mechanical air to liquid vapor regulator valve 500 (hereafter A/L regulator valve). An exemplary A/L regulator valve is shown in European Patent No. 0703186.

Each fuel dispensing point of the fuel dispenser units 200*a* and 200*b* includes a blend manifold 260, a coaxial vapor/liquid splitter 261, a vapor return passage 220, a fuel supply passage 230 and the mechanical A/L regulator valve 500. As shown, the mechanical A/L regulator valve 500 is preferably disposed adjacent the coaxial vapor/liquid splitter 261. The vapor return passages 220 may be joined together before connecting with a common vapor return pipe 410 (FIG. 1).

The fuel dispenser units 200*a* and 200*b* also include liquid fuel dispensing meters 240. The liquid fuel dispensing meters 240 provide dispensed liquid fuel quantity information to the dispenser controller 120 via a liquid fuel dispensing meter interface 270, or control system, and interface wiring 130. The control system 270 may be a microcontroller, a microprocessor, or other electronics with associated memory and software programs running thereon. The control system 270 typically controls aspects of the fuel dispenser units 200*a* and 200*b*, such as a gallons (or liters) display 215, a price display 216, receipt of payment transactions, and the like, based on fuel flow information received from the liquid fuel dispensing meters 240.

The main fuel storage system 300 includes one or more main fuel storage tanks 310*a* and 310*b*. The fuel storage tanks 310*a* and 310*b* are typically provided underground, however, underground placement of the tank is not required for application of the invention. As best seen in FIG. 1, each fuel storage tank 310*a* and 310*b* is connected to the atmosphere by a vent pipe 320. The vent pipe 320 terminates in a pressure relief valve 330. A vapor processor 340 may be connected to the vent pipe 320 intermediate of the fuel storage tanks 310*a* and 310*b* and the pressure relief valve 330. Note, a vapor processor is not typically required in locations that are not subject to enhanced monitoring requirements. In this case, a pressure sensor 350 is operatively connected to the vent pipe 320. The fuel storage tanks 310*a* and 310*b* may also include an Automatic Tank Gauging System (ATGS) 360 used to provide information regarding the fuel level in the storage tanks. The vapor processor 340, the pressure sensor 350, and the automatic tank gauging system 360 are electrically connected to the data acquisition system 140 by third, fourth, and fifth wiring busses 342, 352, and 362, respectively. The fuel storage tanks 310*a* and 310*b* also include a fill pipe and fill tube 370 to provide a means to fill the tanks with fuel and a submersible pump 380 to supply the dispensers 200*a* and 200*b* with fuel from the storage tanks 310*a* and 310*b*.

The means for connecting the fuel dispenser units 200*a* and 200*b* and the main fuel storage system 300 includes a vapor return pipeline 410 and one or more fuel supply pipelines 420. The vapor return pipeline 410 and the fuel supply pipelines 420 are connected to the vapor return passages 220 and fuel supply passages 230, respectively, associated with multiple fuel dispensing points 210. Fuel supply pipelines 420 may be double-walled pipes having secondary containment, as is well known. An exemplary underground fuel delivery system is illustrated in U.S. Pat. No. 6,435,204, which is hereby incorporated by reference in its entirety.

In the embodiment illustrated in FIG. 1, a variable speed vapor pump 250 controlled by a motor 252 is coupled to the plurality of vapor return passages 220 by way of the common vapor return pipeline 410 to assist in the recovery of fuel vapor. In the preferred embodiment shown, variable speed vapor pump 250 may be the Healy VP1200®. An example of this system is found in U.S. Pat. No. 5,040,577, incorporated herein by reference in its entirety.

The data acquisition system 140 receives information regarding the pressure in vapor return pipeline 410 from a pressure sensor 253 that is disposed on the inlet side of vapor pump 250 and electrically connected to the data acquisition system 140 by interface wire 257. The data acquisition system 140 controls the motor 252, via a control line 251, to control the speed of the vapor pump 250 such that a substantially constant pressure is maintained in vapor return pipeline 410, and subsequently on the downstream side of each mechanical A/L regulator valve 500 that is in fluid communication with vapor return pipeline 410. As such, the present vapor recovery system helps control the amount of fuel vapor recovered in proportion to the amount of fuel dispensed.

As shown in FIG. 1, an AFS 501 is deployed in a common branch of the vapor return passages 220 to measure the vapor flows of various groupings of fuel dispensing points 210, down to a minimum of only two dispensing point vapor flows. The latter example is realized by installing one AFS 501 in each of the fuel dispenser units 200*a* and 200*b*, which typically contains two dispensing points 210 (one dispensing point per dispenser side), as shown, or up to six dispensing points in MultiProduct Dispensers (MPD's) (3 per side). The vapor flows piped through the vapor return passage 220 are combined to pass through the single AFS 501 in the dispenser housing. However, alternate embodiments can include an AFS 501 that is dedicated to each individual fuel dispensing point 210 such that each AFS 501 measures the vapor flow from an individual fuel dispensing point 210. Note, air flow sensors are not typically required in locations that are not subject to enhanced monitoring requirements.

Referring additionally to FIG. 3, the internal fuel flow components of one example of the present invention are illustrated. As previously noted, fuel travels from one or more of underground fuel storage tanks 310*a* and 310*b* by way of fuel supply pipelines 420 associated with their respective underground storage tank. The fuel supply pipelines 420 pass into the housing 202 of the fuel dispenser unit 200*a* through shear valves 421 (FIG. 2). The shear valves 421 are designed to cut off fuel flowing through their respective fuel supply pipelines 420 if the fuel dispenser unit 200 is impacted, as is commonly known in the industry. An exemplary embodiment of a shear valve is disclosed in U.S. Pat. No. 6,575,206, which is hereby incorporated by reference in its entirety. Similarly, vapor return passage 220 passes out of the fuel dispenser unit 200*a* through a shear valve 221 (FIG. 2).

As shown in FIG. 3, the fuel flow paths from the underground fuel storage tanks 310*a* and 310*b* to the fuel nozzle 210 each include a fuel filter 246 and a proportional valve 244 positioned along the fuel line 230 upstream of the liquid fuel dispensing meter 240. Alternatively, the proportional valve 244 may be positioned downstream of the liquid fuel dispensing meter 240. The liquid fuel dispensing meter 240 and the proportional valve 244 are positioned in a fuel handling compartment 203 of the housing 202. The fuel handling compartment 203 is isolated from an electronics compartment located above a vapor barrier 205. The fuel handling compartment 203 is isolated from sparks or other events that may cause combustion of fuel vapors, as is well understood and as is described in U.S. Pat. No. 5,717,564, which is hereby incorporated by reference in its entirety.

The liquid fuel dispensing meter 240 communicates through the vapor barrier 205 via a pulser signal line from pulser 241 to the control system 270. The control system 270 regulates the proportional valve 244, via a valve communication line, to open and close during fueling operations. The proportional valve 244 may be a proportional solenoid controlled valve, such as described in U.S. Pat. No. 5,954,080, which is incorporated herein by reference in its entirety. As the control system 270 directs the proportional valve 244 to open to allow increased fuel flow, the fuel enters the proportional valve 244 and exists into the liquid fuel dispenser meter 240. The flow rate of the displaced volume of the fuel is measured by the liquid fuel dispenser meter 240 which communicates the flow rate of the displaced volume of fuel to the control system 270 via the pulser signal line. A pulse signal is generated on the pulser signal line in the example illustrated, such as by a Hall-effect sensor as described in U.S. Pat. No. 7,028,561, which is incorporated herein by reference in its entirety. In this manner, the control system 270 uses the pulser signal from the pulser signal line to determine the flow rate of fuel flowing through the fuel dispenser unit 200*a* and being delivered to the vehicle 12. The control system 270 updates the total gallons dispensed on the gallons display 215 via a gallons display communication line, as well as the cost of fuel dispensed on the price display 216 via a price display communication line.

As fuel leaves the liquid fuel dispensing meter 240, the fuel enters a flow switch 242. The flow switch 242 generates a flow switch communication signal via a flow switch signal line to the control system 270 to communicate when fuel is flowing through liquid fuel dispensing meter 240. The flow switch communication signal indicates to the control system 270 that fuel is actually flowing in the fuel delivery path and that subsequent pulser signals from liquid fuel dispensing meter 240 are due to actual fuel flow.

After the fuel enters the flow switch 242, it exits through the fuel supply passage 230 to be delivered to the blend manifold 260. The blend manifold 260 receives fuels of varying octane values from the various underground fuel storage tanks 310*a* and 310*b* and ensures that fuel of the octane level selected by the consumer is delivered to the consumer's vehicle 12. After flowing through the blend manifold 260, the fuel passes through the fuel hose 212 and fuel nozzle 210 for delivery into the fuel tank 24 of the vehicle 12. Flexible fuel hose 212 includes a product delivery line 231 and the vapor return passage 220. Both lines 231 and 220 are fluidly connected to the underground fuel storage tanks 310*a* and 310*b* through the fuel dispenser unit 200*a*, as previously discussed. The vapor return passage 220 is separated from the product delivery line 231 by the coaxial vapor/liquid splitter 261.

During delivery of fuel into the vehicle's fuel tank 24, the incoming fuel displaces air in the fuel tank 24 containing fuel vapors. Vapor is recovered from the fuel tank 24 of the vehicle 12 through the vapor return passage 220 with the assistance of the vapor pump 250. As previously noted, the vapor pump 250 of the present embodiment is a variable speed pump. The data acquisition system 140 controls the speed of the vapor pump 250, and therefore the pressure level, or vacuum, within the common vapor return pipeline 410 and associated vapor return passage 220. As fuel is dispensed from the fuel nozzle 210 into the fuel tank 24 of the vehicle 12, the flowing fuel causes the mechanical A/L regulator valve 500 to open, thereby opening the vapor return passage 220 to the fuel tank 24.

The vacuum maintained by the vapor pump 250 causes the vapor laden air that is displaced by the ingress of fuel into the fuel tank 24 to be drawn through the A/L regulator valve 500 into the vapor return passage 220. As the rate at which fuel is dispensed increases, more air is drawn through the A/L regulator valve 500 into the vapor return passage 220 and associated vapor return pipeline 410. As more vapor laden air is drawn into the vapor return pipeline 410, the vacuum level sensed by the pressure sensor 253 begins to decrease. The decrease in the vacuum level is reported to the data acquisition system 140 along interface wire 257. In response, the data acquisition system 140 increases the speed at which the motor 252 is driving the vapor pump 250, thereby raising the vacuum level within the vapor return pipeline 410 to its previous level. Conversely, as the amount of fuel being dispensed by the fuel nozzle 210 decreases and less vapor laden air is recovered, the pressure sensor 253 senses the increase in the vacuum within vapor return pipeline 410 and the data acquisition system 140 will reduce speed of the vapor pump 250. In this manner, the data acquisition system 140 is able to maintain a substantially constant pressure on the downstream side of the A/L regulator valves 500, regardless of the number of fuel nozzles that are dispensing fuel and the rate at which the fuel is being dispensed.

Testing reveals that the disclosed system functions as desired when a substantially constant vacuum level as low as 80 mBar is maintained on the downstream side of the A/L regulator valves 500. However, it is possible for small amounts of fuel to be drawn into the vapor return passages 220 through the associated nozzles 210 during vapor recovery. This fuel tends to collect in the lowest portion of the associated vapor return passage 220, thereby effectively blocking the vapor return passage 220 and preventing further vapor recovery if the fuel is not cleared. Although proper vapor recovery is achieved through clear vapor return passages 220 when a constant 80 mBar vacuum is maintained, an 80 mBar vacuum is typically not great enough to ensure that any ingested fuel is further drawn through the vapor pump 250 so that the vapor return passages 220 remain clear and the recovery of vapor is continuous. As such, preferably, a substantially constant vacuum of about 200 mBar may be maintained on the downstream side of the A/L regulator valves 500 in the present embodiment. Note, higher vacuum levels can also be used as long as they are adequate for maintaining the vapor return passages 220 in an unobstructed condition.

Figure 4:
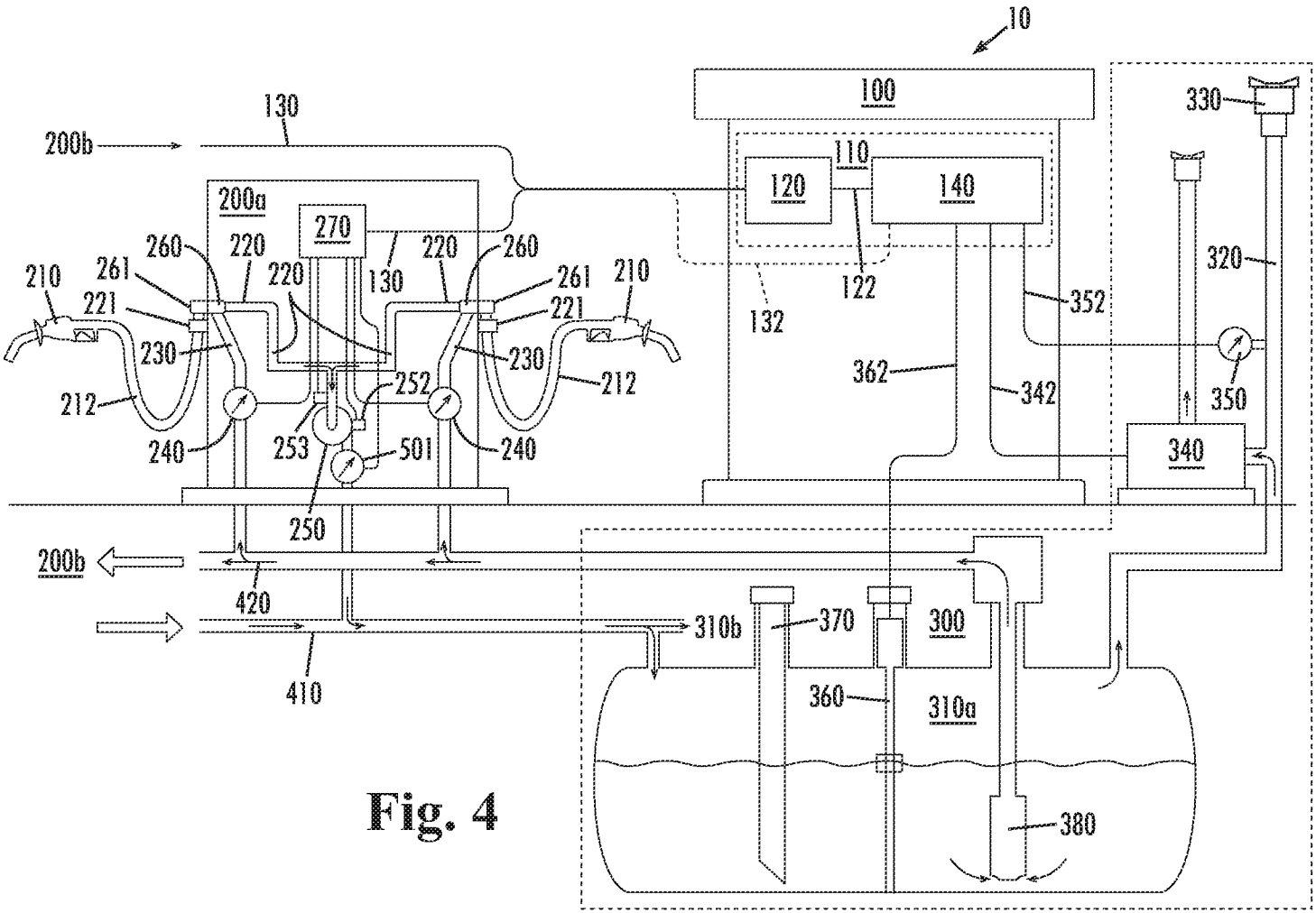
FIG. 4 is a diagrammatic representation of a liquid fuel dispensing facility including a fuel vapor recovery system in accordance with an alternate embodiment of the present invention.
Figure 5:
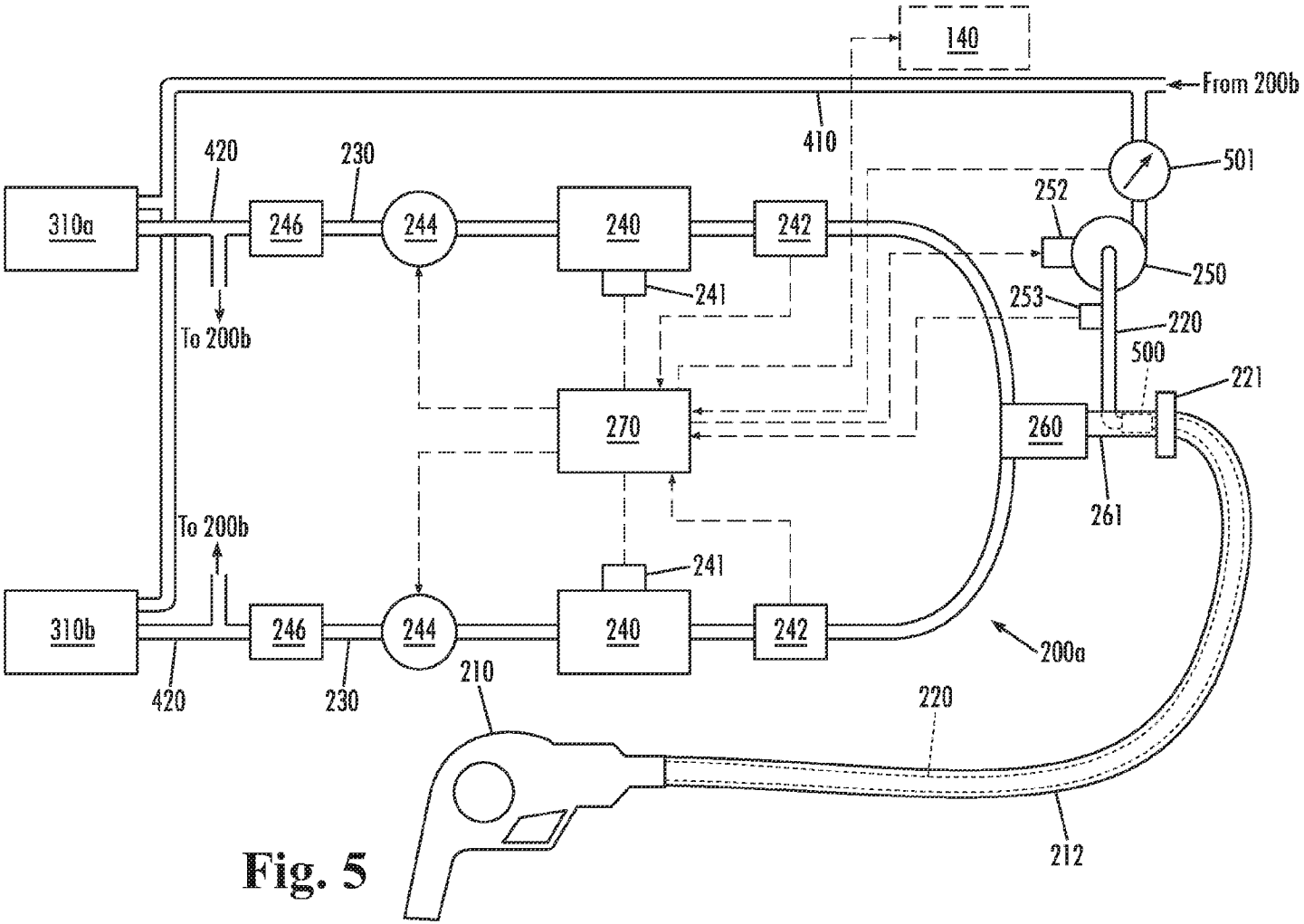
FIG. 5 is a schematic diagram illustrating certain operational characteristics of the fuel dispenser unit as shown in FIG. 4.

A second embodiment of the present invention is shown in FIGS. 4 and 5. The second embodiment differs primarily from the first embodiment in that each fuel dispenser unit 200*a* and 200*b* includes a dedicated vapor pump 250 for the recovery of fuel vapors rather than a single vapor pump 250 that is disposed in the common vapor return pipeline 410 and services multiple fuel dispenser units. As shown, the inlet side of vapor pump 250 is common to both vapor return passages 220 of fuel dispenser unit 200*a* and the outlet side exhausts to the common vapor return pipeline 410. As such, in order to maintain the desired operation of the vapor recovery system, it is the vacuum levels of the vapor return passages 220 within each fuel dispenser unit 200*a* and 200*b* that are maintained at a substantially constant level rather than the vacuum level within the vapor return pipeline 410. Therefore, pressure sensor 253 is positioned on the inlet side of the vapor pump 250 rather than on the vapor return pipeline 410.

An additional difference of the second embodiment is that the control system 270 of each fuel dispenser unit 200*a* and 200*b* controls the operation of its dedicated vapor pump 250 rather than the central data acquisition system 140. The control system 270 receives information regarding the pressure level in the vapor return passages 220 from the pressure sensor 253 that is disposed on the inlet side of vapor pump 250 is in electrical communication with the control system 270 such as by an interface wire. The control system 270 controls the motor 252, via a control line, to control the speed of the vapor pump 250 such that a substantially constant pressure is maintained in the vapor return passages 220, and therefore on the downstream side of each mechanical A/L regulator valve 500. As such, the present vapor recovery system helps control the amount of fuel vapor recovered in proportion to the amount of fuel dispensed.

Figure 6:
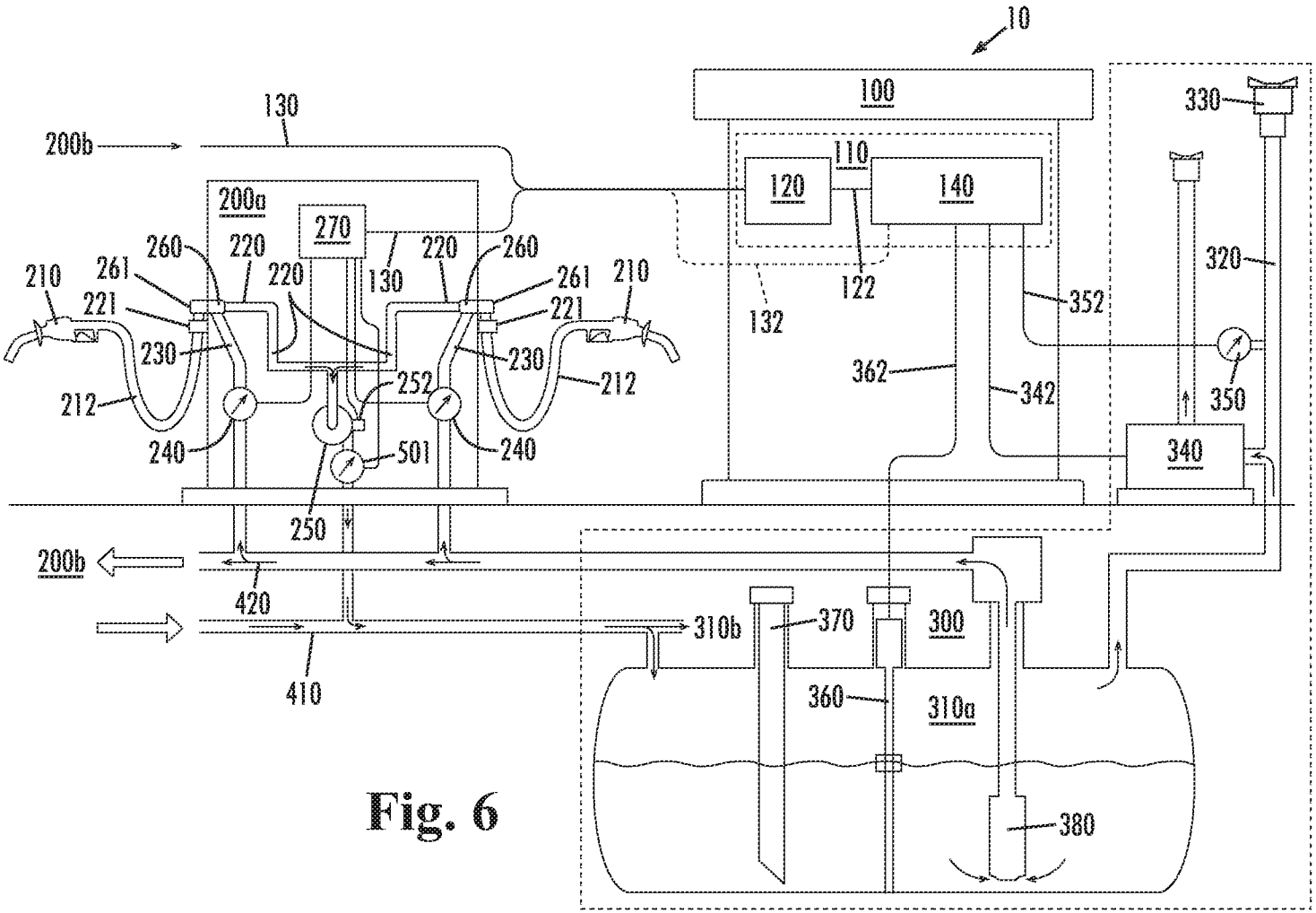
FIG. 6 is a diagrammatic representation of a liquid fuel dispensing facility including a fuel vapor recovery system in accordance with an alternate embodiment of the present invention.

A third embodiment of the present invention is shown in FIG. 6. The third embodiment is similar to the second embodiment in that each fuel dispenser unit 200*a* and 200*b* includes a dedicated vapor pump 250 for the recovery of fuel vapors. As shown, the inlet side of vapor pump 250 is common to both vapor return passages 220 of fuel dispenser unit 200*a* and the outlet side exhausts to the common vapor return pipeline 410. As such, in order to maintain the desired operation of the vapor recovery system, it is the vacuum levels of the vapor return passages 220 within each fuel dispenser unit 200*a* and 200*b* that are maintained at a substantially constant level rather than the vacuum level within the vapor return pipeline 410.

Similarly to the second embodiment of the present invention, in the present embodiment the control system 270 of each fuel dispenser unit 200*a* and 200*b* controls the operation of its dedicated vapor pump 250. The control system 270 of each fuel dispenser unit 200*a* and 200*b* controls the motor 252, via a control line, to control the speed of the dedicated vapor pump 250 such that a substantially constant pressure is maintained in the combined inlet portion of the vapor return passages 220 and, therefore, on the downstream side of the associated mechanical A/L regulator valves 500.

The primary difference of the present embodiment over the previously discussed embodiments is that performance characteristics of the vapor recovery system other than the pressure level maintained in the common vapor return pipeline 410 and vapor return passages 220 can be monitored to assist in maintaining proper operation of the system. For example, in either of the embodiments previously discussed with regard to FIGS. 1 through 3 and FIGS. 4 and 5, the data acquisition system 140 and the control system 270, respectively, receive data indicating the pressure level being maintained in either the common vapor recovery pipeline 410 or the common vapor return passage 220. The data acquisition system 140 (FIG. 1) or control system 270 (FIG. 4) then maintains the desired vacuum by varying the speed of the associated vapor pump 250. In contrast, for the present embodiment, the control system 270 of each fuel dispenser unit 200*a* and 200*b* receives data indicating either the current being drawn by the motor 252 that drives the associated variable speed vapor pump 250 or the speed of the associated vapor pump 250 to determine the load that the vapor pump 250 is under. The control system 270 then maintains the desired vacuum within the combined inlet portion of the vapor return passages 220 by controlling the amount of current that is provided to the motor 252 that drives the vapor pump 250.

More specifically, in the same manner as discussed above, as the amount of fuel that is dispensed by the fuel nozzle 210 increases, the amount of vapor laden air that is drawn into the combined inlet portion of the vapor return passages 220 by the vapor pump 250 increases. This increased load on the vapor pump 250 causes the vapor pump 250 to begin to slow down as more torque is required but the current supplied to the motor 252 remains constant. In response to the reduction in speed, the control system 270 increases the amount of current provided to the motor 252, thereby increasing the amount of torque that is produced. As such, the vapor pump 250 is able to maintain the desired vacuum level within the combined inlet portion of the vapor return passages 220 even though the amount of vapor being drawn through the vapor pump 250 has increased. The control system 270 similarly reduces the amount of current that is supplied to the motor 252 when the load on the vapor pump 250 is reduced.

One preferred method of torque control for the vapor pump 250 is to include current control algorithms within software programs of either the data acquisition system 140 or the control system 270. In short, by controlling the amount of current provided to the motor 252 of the vapor pump 250, the vacuum level within the vapor return pipeline 410 or the vapor return passage 220 can be held substantially constant regardless of the number of active fuel dispensing points and, therefore, the amount of vapor being recovered. As such, the pressure sensors 253 for monitoring the pressure maintained in the common vapor return pipeline 410 or the vapor return passages 220, as previously discussed, are not required when utilizing torque control of the vapor pumps 250.

An alternate embodiment of the present invention differs from the first three embodiments in that each fuel dispenser unit 200*a* and 200*b* includes a pair of dedicated vapor pumps 250 for the recovery of fuel vapors rather than a vapor pump 250 that is disposed in the common vapor return pipeline 410, as shown in FIG. 1, or a common vapor return passage 220, as shown in FIGS. 4 and 6, such that the pump services multiple fuel dispensing points. In this embodiment, the inlet side of each vapor pump 250 is a vapor return passage 220 of a single fuel nozzle 210 and the outlet side of each vapor pump 250 exhausts to a common portion of the vapor return passages 220. As such, in order to maintain the desired operation of the vapor recovery system, it is the vacuum level of the individual vapor return passages 220 within each fuel dispenser unit 200*a* and 200*b* that is maintained at a substantially constant level, rather than the vacuum level within the common vapor return pipeline 410 or a vapor return passage 220 that is common to more than one fuel nozzle 210.

Each of the previously discussed embodiments disclose a vapor recovery system including one or more variable speed vapor pumps. Note, however, that in each of the previously discussed embodiments, the variable speed vapor pumps can be replaced with various types of fixed speed pumps. For example, a swash pump may be used. A swash pump is a form of pump in which nutatory motion of a swash plate within a pumping chamber defined by opposing cone plates causes a fluid to move from an inlet port to an outlet port. The two ports are adjacent but separated by a divider that transects the swash plate and the pumping chamber. In relation to the present application, it should be noted that the volume output of a swash pump is closely related to the rate of turning of the drive shaft over a wide range.

More specifically, a swash pump can be used wherein the data acquisition system 140 or controller 270 varies the angle of the pump's swash plate to maintain substantially constant pressure on the inlet side of the pump, a rotary vane pump can be used wherein the eccentricity of the pump's vanes is varied to maintain a substantially constant inlet pressure, and a piston pump can be used wherein a mechanical pressure regulator operates across the inlet and outlet sides of the pump to maintain the desired constant inlet pressure. Additionally, electronic proportional valves (not shown) can be disposed on the upstream side of various fixed speed pumps and used to selectively control the pressure that is maintained on the downstream side of an associated A/L regulator valve. These are just a few examples of fixed speed pumps that can be used in alternate embodiments of the present invention.

As discussed above, the control system 270 receives information from liquid fuel dispensing meter 240 and the pulser 241 regarding the amount of fuel being dispensed. The liquid fuel dispensing meter 240 measures the fuel being dispensed while the pulser 241 generates a pulse per count of liquid fuel dispensing meter 240. In an exemplary embodiment, the pulser 241 generates one thousand and twenty-four (1024) pulses per gallon of fuel dispensed. In yet another alternate embodiment of the present invention, the control system 270 provides fuel flow information to the data acquisition system 140 by way of the interface wiring 130. As previously noted, the data acquisition system 140 may be a microprocessor, microcontroller, etc. with an associated memory that is calibrated with calibration or vapor pump control values that control the vapor pump 250 in correlation to the fuel dispensed or fuel dispensing rate for a variable speed vapor pump, or adjusts proportional flow control valves for a constant speed vapor pump. In this embodiment, pressure sensor 253 is not necessary since the rate at which vapor pump 250 is used to recover vapor is determined by the amount of fuel the data acquisition system 140 determines is being dispensed, based on the information provided by the liquid fuel dispensing meters 240 via interface wiring 130. The vapor pump 250 may be a variable speed pump or a constant speed pump with an electronic proportional valve, a mechanical pressure regulator operating across its inlet and outlet, etc., as previously discussed.

An alternate embodiment of the invention exploits the relatively low-friction aspect of a swash pump, although it would be possible to apply the invention to any kind of positive-displacement vapor pump capable of being driven by a directly coupled multiple-phase motor connected to an output of a suitable controller having at least some computational capability.

A version of a swash pump optimized for air or other gases, for example the Model No. A05 swash pump by SwashPump Technologies Limited, Auckland, New Zealand, has previously been described in PCT/NZ2009/000198, filed Sep. 18, 2009, particularly in a form that is integrated with a controller for a brushless DC three-phase motor having a permanent-magnet rotor and fixed stator windings. Many such controllers can determine indirectly, through the motor load, what the pump operating conditions are likely to be. Some versions may use the phase relationship between the current applied an the magnetic signal derived from a magnetic field sensor to determine what the torque might be. More particularly, the revolution rate and the current drawn are inputs made available to a control algorithm within the supplied controller at any instant. This specification will describe how a pump and its controller can be altered to serve as a stand-alone, pressure-regulated source or sink of a gas; in this instance, a sink of fuel-saturated vapor.

This example sets out to provide suitable operating conditions for an A/L valve used with a fuel dispenser while using a minimum number of parts in a low total-cost-of-ownership arrangement. After being set up, the swash pump, motor, and associated variable-speed controller with maintain a particular negative pressure relative to atmospheric pressure at the input to the vapor recovery pump, regardless within reason of how much flow, or, many delivery nozzles are active at any time. Strictly, the pressure difference is maintained between the inlet port and the outlet port of the pump, rather than between the inlet and the local air space. Two nozzles in use at one time is a reasonable limiting number. The controller would be powered to turn the pump at a suitable rate at any time that either or both of the delivery nozzles are taken off their hooks or holders for a tank filling procedure. One suitable negative pressure is 200 millibars, since that amount will ensure the withdrawal and disposal through the pump or an inadvertent slug of liquid fuel. The swash pump and controller may replace vacuum pumps of known systems. As well, the A/L valves and proportional control valves of known systems may not be required.

The volume of gas pumped through the vapor recovery pump may vary from zero through 40, 90, 140 and up to 280 liters per minute (converted to STP conditions) assuming in the worst case that the device is used in conjunction with a dispenser having two nozzles each capable of delivering 140 liters per minute of liquid fuel.

Specific manufacturer's A/L valve requirements may differ and this example assumes an Elaflex type, for which a constant suction pressure of 200 millibars is recommended. If the pressure is maintained constant, the volume of vapor removed from the tank is within 5% of the volume of fuel delivered, which is within tolerance according to most legislation. This ZVA 200 GRVP integrated proportional valve—located at the nozzle—includes a fine tuning screw to allow recalibration at installation or during periodic maintenance.

Figure 9:
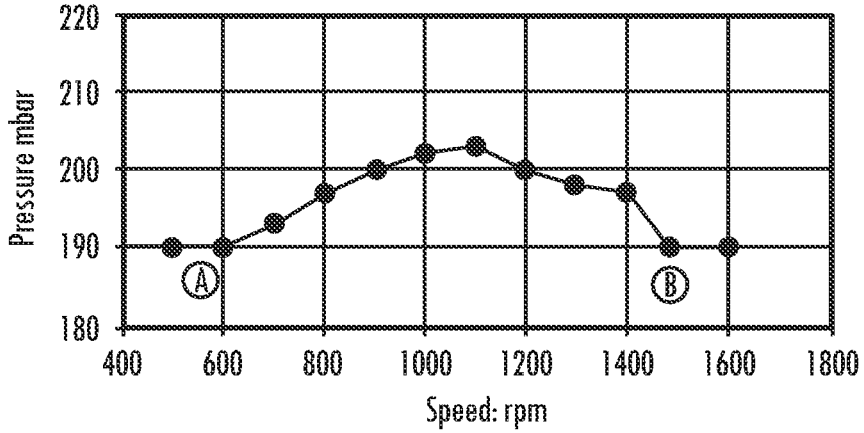
FIG. 9 is a graph showing test results for a swash pump and controller after being set up in accordance with an alternate embodiment of the present invention.

One advantage of providing a constant pressure, as shown for an actual test pump in FIG. 9, is that where a vapor recovery vacuum pump is shared between two nozzles, the conditions at either nozzle are not significantly affected by activity at the other nozzle, apart from pressure drops caused by gas flow along common hose lines and through connectors. Had a significantly non-constant relationship been used (which is equally feasible with the present method), it might be necessary to have a separate installation for each A/L valve.

For this prototype development a Wellington Drives type 350 intelligent controller (Wellington Drives Ltd., Auckland, New Zealand) is used. An existing "fixed torque" control algorithm or torque regulation means is included in these controllers. This algorithm allows individual calibration of stored variables so that a constant torque such as 40% or 45% of the maximum torque available is held during use, regardless of actual speed, for other motor applications in which an air fan is driven. Rotational torque is detected by electrical means such as by sensing the current drawn through the stator windings, which the rate of rotation is also known to the controller as the current stepping rate for sequencing current through one coil and then another, or as the detected pulses for a magnetic field sensor placed close to the magnets on the rotor. The torque control algorithm essentially comprises repeatedly adjusting the supplied current according to a precalculated lookup table or formula which uses stored constants derived from low and high speed torque measurements at different speeds so that the torque provided is constant (such as a horizontal line 801 in a graph similar to FIG. 8). A control loop within the controller constantly tests the presently detected torque against the intended torque, at whatever speed the motor is turning. Other methods for sensing a torque which can be used with other kinds of variable-sped motor drive also exist, as will be known to those skilled in the art; for instance measuring the voltage or current developed in a non-energized winding, use of a resilient pump mounting and a strain gauge indicating the force required to turn the pump, or a resilient coupling between the pump and the motor with a magnetic phase-sensitive rotation detector means placed across the resilient element.

Figure 7:
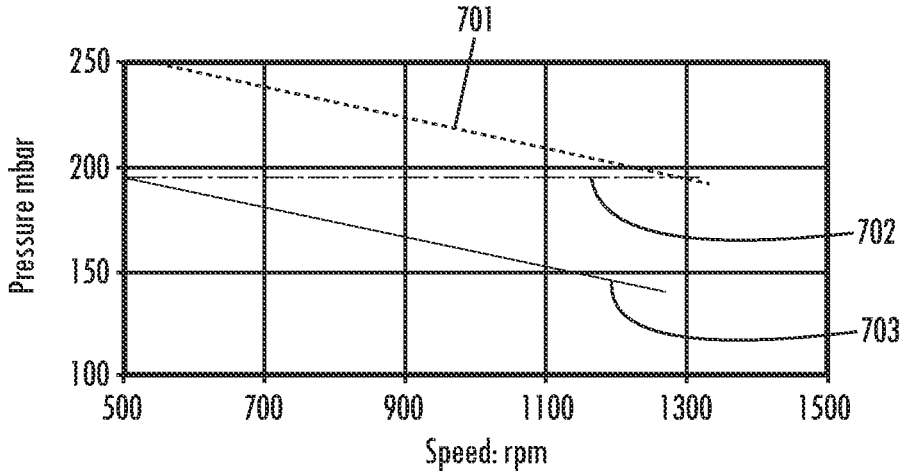
FIG. 7 is a graph showing a relationship between pressure and speed for a volumetric pump, such as a swash pump with its controller, in accordance with an alternate embodiment of the present invention.
Figure 8:
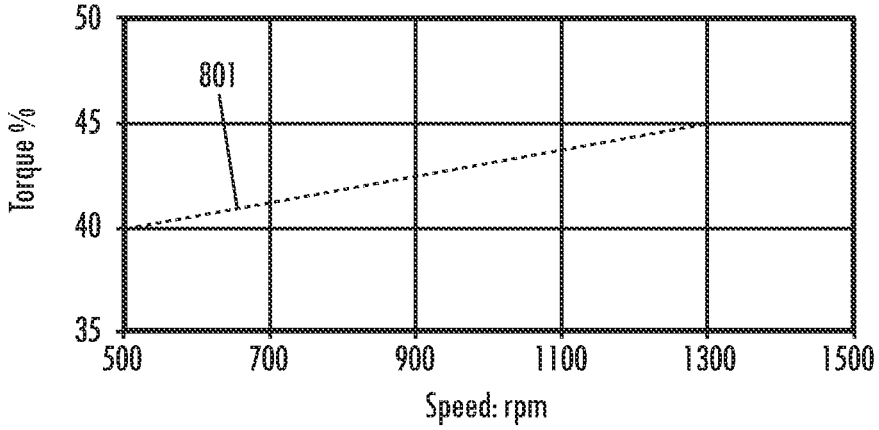
FIG. 8 is a graph showing a relationship between torque and speed for a swash pump with its controller, in accordance with an alternate embodiment of the present invention.

In the present example, the existing torque regulation means is caused to supply a constant pressure as shown in FIG. 7. During the setup procedure as detailed below, the motor is forced by operation of a software routine to turn at a first, constant low speed such as 500 rpm. The pump inlet is connected to a pressure gauge (relative to air) and to a variable throttle valve which is altered to give a certain pressure such as −200 mbar. Once the pressure is stable, the torque is measured and recorded by the controller at that first set point. Then the motor is forced as before to turn at a second constant high speed such as 1300 rpm. The variable throttle valve is altered to give the same pressure and the different torque is measured and recorded by the controller at that second set point. This procedure creates a stand-alone, pressure-regulated suction pump—at least within practical limits. In FIG. 7, a pressure/speed graph, the pressure/speed line for 45% torque is shown as 701 and the pressure/speed line for 40% torque is shown as 703. After the setup procedure the pressure developed at different speeds should be substantially constant as shown by line 702. After calibration based on pressure, the torque setting, as shown in FIG. 8, varies in proportion to speed, so that more torque is provided at the higher speed.

This procedure inherently takes into account frictional losses occurring within the drive and the pump, and electrical losses within the motor. At the time of writing, the issue of "between-pump consistency" such as with respect to sliding friction has not been assessed so it is not clear as to whether each separate pump will require calibration, whether periodic re-calibration as required as the sliding parts of the pump become worn, or whether a single set of data can be used in all pumps and motors of a particular model or type, providing a sufficiently accurate pressure. As a result, a pump with controller according to this example provides a relatively constant suction pressure (P) at the A/L valve despite changes in flow rate as may occur if (for example) a second outlet from a dispenser is brought into use, if either nozzle is only partially opened, or if a larger delivery rate is selected for larger vehicle tank.

Field or factory calibration is done by:

1. Attaching a control panel by an existing programming connector on a suitable Wellington Drives controller or equivalent type, also including a software modification for accepting calibration inputs, and temporarily sealing a pipe including a pressure meter on the pump side of a throttling valve to the input port of the pump. The control panel may be a virtual device included in a personal-computer interface, or a simple pair of buttons labeled "A" and "B" and connected to two input ports on the controller.
2. Activating the pump in its intended environment or on a test bed, with the controller in a "learn" mode for an alignment procedure.
3. Press a button "A" on the control panel, the closing of which is coupled to an input line on the controller that through existing software causes the controller to make the motor turn at 500 rpm.
4. Use the throttling valve to set the suction pressure to 200 millibars.

5. Press the button "A" a second time on the control panel, which causes the low-speed set point to be remembered (in the form of a 41% torque at that speed in this example).
6. Press a button "B" on the control panel, which causes the controller to make the motor turn at 1300 rpm.
7. Use the same throttling valve to set the suction pressure to 200 millibars.
8. Press the Button "B" again on the control panel, which causes the high-speed set point to be remembered in the form of an about 45% torque.

FIG. 9 shows a single example of measured results. The maximum variation is 13 millibars around a design center of 200 millibars, between 500 and 1600 rpm. If true torque control had been used, the pressure variation would be 50 millibars. This curve could be nearly flattened if a third, midway point was also used as a calibration point, which is quite feasible. Alternatively, any of a wide range of transfer functions such as simple or complex curves could be created by the use of sufficient extra points.

Once this change is made, the "start" inputs of the drive controller board for the vapor recovery pump are connected to both the nozzle 1 hook signal lead and to the nozzle 2 hook signal lead (assuming a two-nozzle type dispenser) so that when either or both nozzles are off-hook and put into use, an adequate, regulated suction level will be applied to both A/L valves in a dual dispenser. One or both A/L valves will admit vapor into the vapor recovery line when fuel is actually being dispensed, whereupon the self-regulating pump turns faster in order to maintain the constant pressure. If the internal sliding friction of the pump changes over time the calibration will need to be re-done, since that friction consumes part of the power from the motor. How much change can be tolerated remains to be assessed.

If a bolus of liquid fuel is inadvertently pulled into the vapor recovery tubes, which must be allowed for, it will cause a temporary upset to torque/speed measurements. There is likely to be a temporary demand for more torque than the controller can produce. Since the swash pump option in particular is robust and not damaged by having to pump a non-compressible fluid, the system or motor and controller can be expected to return to normal as soon as the fluid has passed.

Variations of this example are as follows:

1. Although a constant suction pressure device is created with the simple set up described, the speed/pressure relationship may be given a positive slope or a negative slope at the time of calibration, in case a particular kind of A/L valve should require it, or to at least partially overcome pipeline flow resistance.
2. The speed/pressure relationship may be made into a non-linear relationship by including further points that define a simple or a complex curve.
3. Instead of per-unit calibration, the same calibration data may be loaded into every one of a consistent product type, based on actual calibration data derived from a statistical sample of the product type.
4. The invention can be used as a building block in other applications where a relatively constant pressure at a pump output, or a known pressure/flow relationship, whether the pressure is positive or negative, is required regardless of flow rate. Applications include air conditioning, process control, and medical applications.
5. The procedure described above could be modified, by substituting a mass flow meter such as a Coriolis meter for the pressure sensor, to create a volumetric pump with controller adapted to provide a relatively constant mass flow; useful in some forms of process control.

The invention as described in this example, as well as in New Zealand Provisional Patent Application No. 584410, filed Apr. 1, 2010, the entire disclosure of which is incorporated by reference herein, provides an "intelligent vacuum pump" for an installation within a fuel dispenser according to prior art systems, where the proportional valve, a possible bleed valve, and the vacuum pump are replaced by a single vapor recovery swash pump coupled to a brushless DC motor having a suitably programmed controller. It is an inherently self-regulating device. This replacement complies with the "stand-alone" or "direct substitution" preferred approach to field modifications of dispensers. Advantages include:

1. Lower parts count and total cost of ownership. No bleed valve type regulation is required, no pressure transducer is required, and the pump turns no faster than necessary.
2. Lower parts count for a dual-nozzle dispenser, since the one self-regulating device can span the range of one or both nozzles simultaneously operating.
3. Accuracy of the ratio between delivered fuel and removed vapor is assured, more so than with existing designs, since the A/L valve is backed up with a constant pressure drop.
4. No connection to the or each fuel meter is made or needed.
5. The swash pump option is inherently able to cope with slugs of liquid fuel.
6. The swash pump option is inherently quiet.
7. Power consumption, and wear, are proportional to need. Longevity is increased since the vapor recovery pump runs just fast enough to achieve the desired suction, whereas prior-art pumps run at full speed and then the pressure is regulated externally.

While preferred embodiments of the invention have been shown and described, modifications and variations thereto may be practiced by those of ordinary skill in the art without departing from the spirit and scope of the present invention, which is more particularly set forth in the appended claims. In addition, it should be understood the aspects of the various embodiments may be interchanged without departing from the scope of the present invention. Furthermore, those of ordinary skill in the art will appreciate that the foregoing description is by way of example only, and is not intended to limit the invention as further described in such appended claims.

What is claimed is:

1. A system for controlling a vapor recovery system that recovers vapors expelled from a vehicle during refueling at a fuel dispensing point and returns the vapors to an underground storage tank in a service station environment, comprising:

an air to liquid regulator valve associated with the fuel dispensing point, the air to liquid regulator valve being configured to regulate an amount of vapor that is recovered through the fuel dispensing point for a given amount of fuel that is dispensed through the fuel dispensing point;

a vapor pump that is in fluid communication with the air to liquid regulator valve, the vapor pump having an inlet side and an outlet side;

a vapor flow path that is in fluid communication with the air to liquid regulator valve and the vapor pump; and a controller operatively connected to the vapor recovery system adapted to:

monitor a parameter of the vapor recovery system; and maintain a substantially constant pressure level in a first portion of the vapor flow path that is disposed between the inlet side of the vapor pump and the air to liquid regulator valve.

2. The system of claim 1, wherein the parameter of the vapor recovery system that is monitored by the controller is a pressure value within the first portion of the vapor flow path.

3. The system of claim 2, wherein the vapor recovery system further comprises a pressure sensor operatively connected to the first portion of the vapor flow path.

4. The system of claim 2, wherein the vapor recovery system further comprises a variable speed motor that drives the vapor pump.

5. The system of claim 4, wherein the controller is further adapted to adjust an amount of current that is provided to the variable speed motor of the vapor pump in response to the pressure value at the first portion of the vapor flow path.

6. The system of claim 4, wherein the controller is further adapted to control the amount of torque that is provided to the vapor pump by the variable speed motor in response to the pressure valve at the first portion of the vapor flow path.

7. The system of claim 1, wherein the vapor recovery system further comprises a variable speed motor that drives the vapor pump, and the parameter of the vapor recovery system that is monitored by the controller is an amount of current that is being drawn by the variable speed motor.

8. The system of claim 7, wherein the controller is further adapted to adjust an amount of current that is provided to the variable speed motor of the vapor pump in response to the amount of current that is being drawn by the variable speed motor.

9. The system of claim 1, wherein the vapor recovery system further comprises a variable speed motor that drives the vapor pump and the parameter of the vapor recovery system that is being monitored by the controller is a speed of rotation of the vapor pump.

10. The system of claim 9, wherein the controller is further adapted to adjust an amount of current that is provided by the variable speed motor of the vapor pump in response to the speed of rotation of the vapor pump.

11. The system of claim 1, wherein the vapor pump is a fixed speed pump.

12. The system of claim 11, wherein the fixed speed pump further comprises one of a swash pump, a rotary vane pump and a piston pump.

13. The system of claim 12, further comprising an electronic proportional valve that is disposed in the first portion of the vapor flow path between the vapor pump and the air to liquid regulator valve.

14. The system of claim 1, further comprising a plurality of fuel dispensing points that are in fluid communication with the first portion of the vapor flow path, each fuel dispensing point including a corresponding air to liquid regulator valve.

15. A method of operating a vapor recovery system that recovers vapors expelled from a vehicle during refueling at a fuel dispensing point and returns the vapors to an underground storage tank through a vapor flow path that is in fluid communication with an air to liquid regulator valve and a vapor pump, comprising:

dispensing fuel into the vehicle through the fuel dispensing point;

regulating an amount of vapor that is recovered through the fuel dispensing point with the air to liquid regulator valve in proportion to the fuel dispensed into the vehicle;

detecting a parameter of the vapor recovery system; and maintaining a substantially constant pressure level in a first portion of the vapor return path that is disposed between the vapor pump and the air to liquid regulator valve.

16. The method of claim 15, further comprising controlling the operation of the vapor pump in response to the detected parameter of the vapor recovery system.

17. The method of claim 15, wherein the detected parameter of the vapor recovery system is a pressure value of the first portion of the vapor return path.

18. The method of claim 15, wherein the detected parameter of the vapor recovery system is an amount of current that is drawn by the vapor pump.

19. The method of claim 15, wherein the detected parameter is a rate of rotation of the vapor pump.

20. The method of claim 15, wherein the step of maintaining a substantially constant pressure further comprises varying a rate of rotation of the vapor pump by adjusting an amount of current that is provided to the vapor pump.

21. The method of claim 15, wherein the step of maintaining a substantially constant pressure is performed by a fixed speed pump.

22. A system for controlling a vapor recovery system that recovers vapors expelled from a vehicle during refueling at a fuel dispensing point and returns the vapors to an underground storage tank in a service station environment, comprising:

an air to liquid regulator valve associated with the fuel dispensing point, the air to liquid regulator valve being configured to regulate an amount of vapor that is recovered through the fuel dispensing point for a given amount of fuel that is dispensed through the fuel dispensing point;

a vapor pump that is in fluid communication with the air to liquid regulator valve, the vapor pump having an inlet side and an outlet side;

a vapor flow path that is in fluid communication with the air to liquid regulator valve and the vapor pump; and a mechanical regulator valve that is in fluid communication with both the inlet side and the outlet side of the vapor pump, wherein the mechanical regulator valve is adapted to maintain a substantially constant pressure level in a first portion of the vapor flow path that is disposed between the inlet side of the vapor pump and the air to liquid regulator valve.

23. A method of operating a vapor recovery system that recovers vapors expelled from a vehicle during refueling at a fuel dispensing point and returns the vapors to an underground storage tank through a vapor flow path that is in fluid communication with an air to liquid regulator valve and a vapor pump driven by a variable speed motor, comprising:

dispensing fuel into the vehicle through the fuel dispensing point;

regulating an amount of vapor that is recovered through the fuel dispensing point with the air to liquid regulator valve in proportion to the fuel dispensed into the vehicle;

detecting a parameter of the vapor recovery system, the parameter being related to rotational torque of the vapor pump;

determining a rate of rotation of the vapor pump;

comparing the detected parameter of the vapor recovery system to a look-up table of stored constants derived from measuring rotational torque of the vapor pump at various rates of rotation; and adjusting the detected parameter of the vapor pump such that the rotational torque of the vapor pump is substantially constant so that a substantially constant pressure is maintained at an inlet to the vapor pump.

24. The method of claim 23, wherein the detected parameter is determined by measuring a current developed in a non-energized winding of the variable speed motor that drives the vapor pump.

* * * * *